US006745433B2

(12) United States Patent
Newman et al.

(10) Patent No.: US 6,745,433 B2
(45) Date of Patent: Jun. 8, 2004

(54) SIDE LOAD BALANCE CORD TERMINAL CLIP

(75) Inventors: Gary R. Newman, Valley Springs, SD (US); Lawrence J. VerSteeg, Sioux Falls, SD (US); Stuart J. Uken, Sioux Falls, SD (US)

(73) Assignee: Amesbury Group, Inc., Amesbury, MA (US)

( * ) Notice: Subject to any disclaimer, the term of this patent is extended or adjusted under 35 U.S.C. 154(b) by 0 days.

(21) Appl. No.: 10/226,893

(22) Filed: Aug. 23, 2002

(65) Prior Publication Data

US 2003/0056320 A1 Mar. 27, 2003

Related U.S. Application Data

(60) Provisional application No. 60/314,748, filed on Aug. 24, 2001.

(51) Int. Cl.[7] ..... E05F 1/00; E05F 3/00
(52) U.S. Cl. ..... 16/207; 16/202; 16/208
(58) Field of Search ..... 16/194, 198, 202–208; 411/477, 478, 401; 248/62, 63; 49/322, 423, 429, 430, 445

(56) References Cited

U.S. PATENT DOCUMENTS

| | | | | | |
|---|---|---|---|---|---|
| 817,039 | A | * | 4/1906 | Broome | 16/203 |
| 1,045,553 | A | * | 11/1912 | House | 16/207 |
| 1,079,685 | A | * | 11/1913 | Asher | 16/203 |
| 2,128,007 | A | * | 8/1938 | Mantz | 16/202 |
| 2,226,721 | A | * | 12/1940 | Huff | 16/198 |
| 2,807,838 | A | * | 10/1957 | Perry | 49/423 |
| 3,160,914 | A | * | 12/1964 | Brienza | 16/206 |
| 4,089,085 | A | * | 5/1978 | Fitzgibbon | 16/197 |
| 4,642,845 | A | * | 2/1987 | Marshik | 16/194 |
| 4,697,304 | A | * | 10/1987 | Overgard | 16/198 |
| 4,844,651 | A | * | 7/1989 | Partridge | 403/386 |
| 4,914,862 | A | * | 4/1990 | Gregory | 49/322 |

FOREIGN PATENT DOCUMENTS

| | | |
|---|---|---|
| CA | 2382933 | * 12/2002 |

* cited by examiner

*Primary Examiner*—Chuck Y. Mah
(74) *Attorney, Agent, or Firm*—Testa, Hurwitz & Thibeault, LLP

(57) ABSTRACT

Disclosed are apparatus for a block and tackle window balance including a terminal clip to be incorporated in single and double hung window assemblies. In one embodiment the terminal clip includes a first end portion defining an opening for passing a terminal end of a cord therethrough, a second end portion disposed remotely from the first end portion, and an intermediate portion including a hook and extending between the first and second end portions.

20 Claims, 12 Drawing Sheets

SIDE LOAD BALANCE CORD TERMINAL CLIP

RELATED APPLICATION

This application incorporates by reference in its entirety and claims priority to U.S. Provisional Patent Application Serial No. 60/314,748 entitled Side Load Balance Cord Terminal Clip filed on Aug. 24, 2001.

TECHNICAL FIELD

This invention relates to terminal clips that transfer force from a cord of a block and tackle window balance to a window jamb to hold up a window sash, and, more particularly to a terminal clip that protects the cord from cutting and abrasion during operation of the block and tackle window balance.

BACKGROUND INFORMATION

Hung window assemblies generally include a window frame, a lower window sash, an upper window sash, a pair of window jambs, two sets of jamb pockets, and at least one window balance device for offsetting the weight of a window sash throughout a range of travel within the window frame. Block and tackle window balance devices use a combination of a spring and pulleys located within a channel to balance the weight of the window sash at any position within the jamb pockets.

When installed in a window frame, the block and tackle window balance device is secured to the window sash and is connected to the window jamb via the terminal clip. The terminal clip, which is attached to a cord connecting the pulleys of the block and tackle window balance, is hooked into an opening within the window jamb. In prior art terminal clips, the cord is attached to a bottom portion of the terminal clip (e.g., below a hooked portion of the terminal clip).

In some prior art window balance devices, the cord is attached via a knot to the bottom portion of the terminal clip and thus, is exposed as the highest projection point on the terminal clip. A disadvantage of this type of connection between the cord and the terminal clip is that the exposed cord may be cut or frayed by the block and tackle window balance device during normal operation of the block and tackle window balance. In other prior art window balance devices, the cord is crimped to the bottom portion of the terminal clip. A disadvantage of this type of connection between the cord and the terminal clip is that typically the cord pulls out from a crimped connection at a lower pull out force than for a knotted connection.

SUMMARY OF THE INVENTION

In general, in one aspect, the invention relates to a terminal clip for attaching a block and tackle window balance device to a window jamb. The terminal clip protects a cord of the block and tackle window balance device from cutting and abrasion during operation. In one embodiment, the terminal clip includes a first end portion defining an opening for passing a terminal end of a cord therethrough, a second end portion disposed remotely from the first end portion, and an intermediate portion extending between the first end portion and the second end portion. The intermediate portion includes a hook for attaching the terminal clip to a window frame.

In another embodiment, the terminal clip includes a second end portion that includes a bend and defines at least one second end opening for the cord to pass through. In another embodiment, the second end portion defines two second end openings for the cord to pass through.

In yet another embodiment, the terminal clip is made from stainless steel. In other embodiments, the terminal clip is formed of unitary construction. In another embodiment, the terminal end of the cord is knotted. In yet another embodiment, the knot is disposed in an aperture that receives the hooked end when the terminal clip is installed in the window. In one embodiment, when the terminal clip is installed in the window frame, the cord is shielded so as not to extend beyond an uppermost extent of the terminal clip.

In general, in another aspect, the invention relates to a terminal clip for a balance for a window. The terminal clip includes a first end defining at least two openings for a cord to pass through, and a hooked end disposed remotely from the first end and wherein the cord terminates proximate to the hooked end. In one embodiment, the first end of the terminal clip includes a bend between the at least two openings. In another embodiment, the terminal clip is formed of unitary construction. In yet another embodiment, when the terminal clip is installed in a window, the cord is shielded being disposed so as not to extend beyond an uppermost extent of the terminal clip.

In general, in one aspect, the invention relates to a terminal clip for a window. The terminal clip includes a first end and a hooked end disposed remotely therefrom. The hooked end defines an opening for passing a terminal end of a cord therethrough.

In one embodiment, the first end of the terminal clip defines at least one opening for the cord to pass through. In another embodiment, the terminal clip is formed of unitary construction. In yet another embodiment, the terminal end of the cord includes a knot. In still yet another embodiment, the knot is disposed in an aperture that receives the hooked end when the terminal clip is installed in the window. In one embodiment, when the terminal clip is installed in a window, the cord is shielded being disposed so as not to extend beyond an uppermost extent of the terminal clip.

In general, in another aspect, the invention relates to a block and tackle window balance device for use in single or double hung windows. The block and tackle window balance device includes a channel, a fixed pulley block unit, a translatable pulley block unit, a spring with a first end and a second end, a cord, and a terminal clip. The spring, the translatable pulley block unit, and the fixed pulley block unit are all located within the channel. The first end of the spring and the fixed pulley block unit are fixed at opposite ends of the channel. The cord has a first end and a second end and connects the translatable and fixed pulley block units. The first end of the cord is attached to the translatable pulley block and a second end is attached to the terminal clip. The terminal clip includes a first end and a hooked end disposed remotely from the first end. The hooked end of the terminal clip defines an opening for passing the second end of the cord therethrough.

The foregoing and other objects, aspects, features, and advantages of the invention will become more apparent from the following description and from the claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
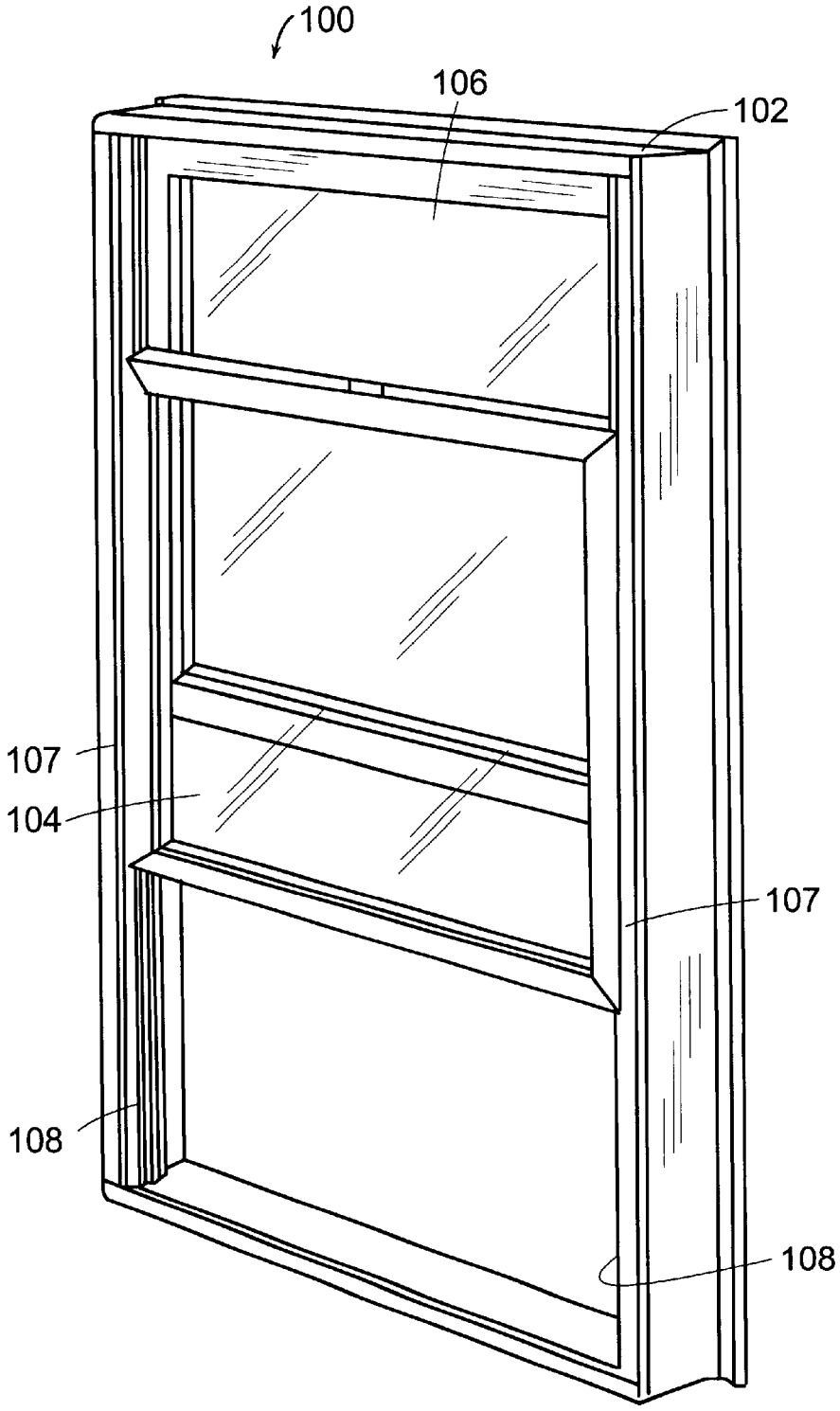
FIG. 1 is a perspective view of a double hung window.

Referring to FIG. 1, shown is a double hung window assembly 100 in which a block and tackle window balance including a terminal clip constructed in accordance with the teachings of the present invention can be used. The double hung window assembly 100 includes a window frame 102, a lower window sash 104, an upper window sash 106, and a pair of window jambs 107. Within each window jamb 107, jamb pockets 108 are defined. The lower window sash 104 and upper window sash 106 slide vertically within the jamb pockets 108. Generally, window balances are attached to the lower and upper window sashes 104, 106 to balance the weight of the window sashes at any vertical position within the jamb pockets 108.

Figure 2A:
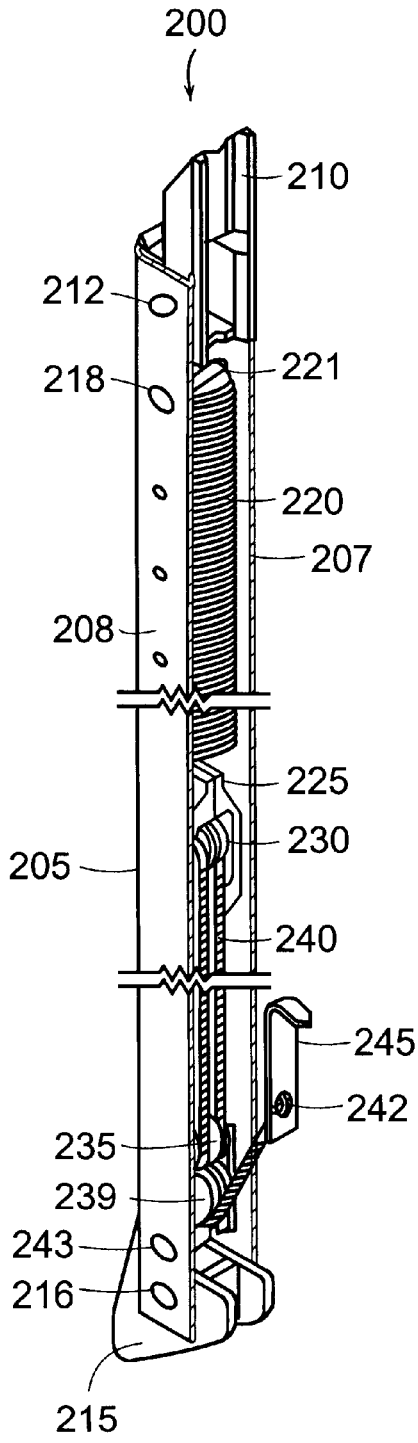
FIG. 2A is a perspective view of a block and tackle window balance including a prior art terminal clip.
Figure 2B:
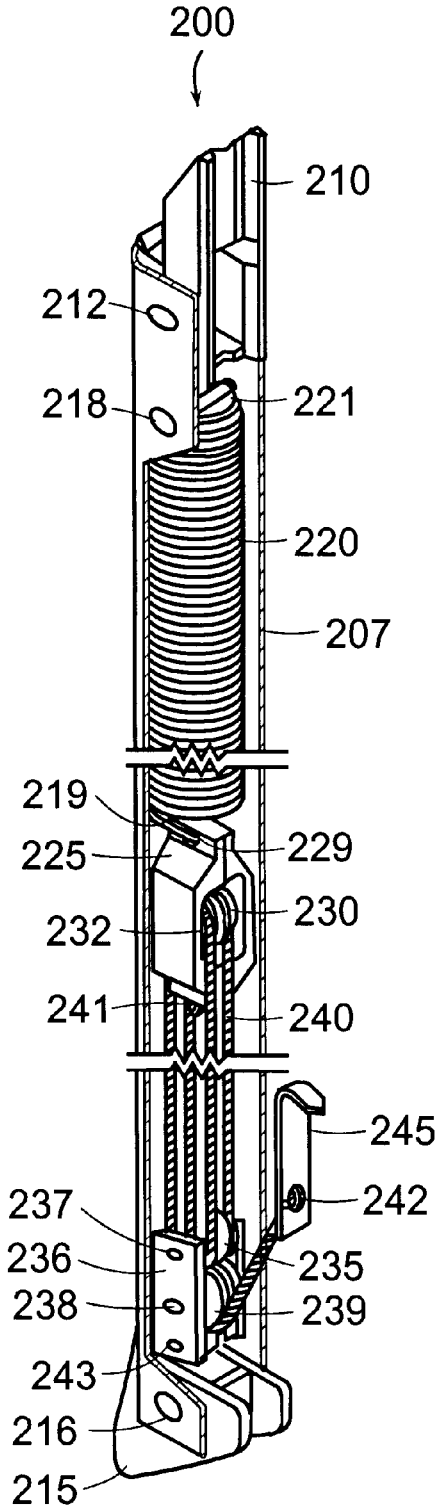
FIG. 2B is another perspective view of the block and tackle window balance of FIG. 2A with one of two side walls of the U-shaped channel removed.
Figure 3:
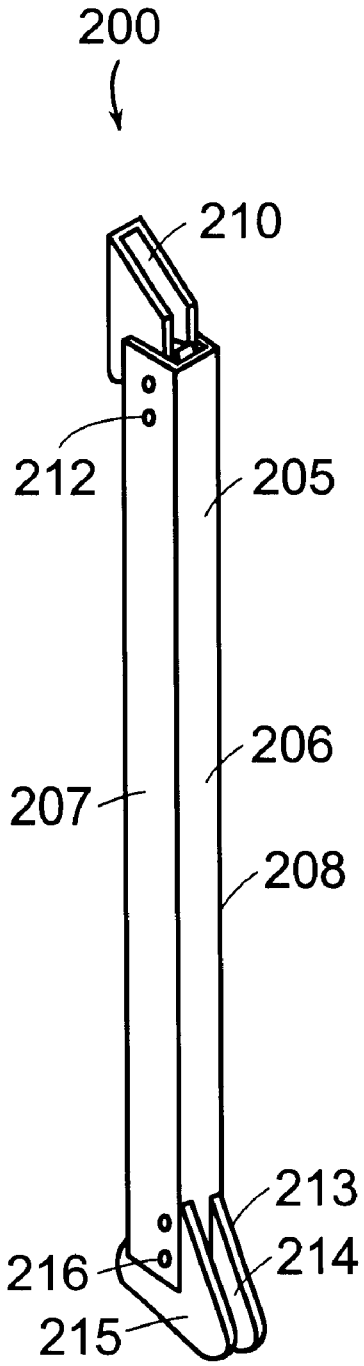
FIG. 3 is a perspective rear view of the block and tackle window balance of FIG. 2A.

FIGS. 2A, 2B, and 3 show perspective views of a block and tackle window balance 200 including a prior art terminal clip 245. FIG. 2A shows the block and tackle window balance 200 in full, whereas FIG. 2B shows the block and tackle window balance 200 with one side wall of a rigid U-shaped channel 205 cut away so that components within the window balance 200 are more visible. FIG. 3 shows a rear view of the window balance 200.

The block and tackle window balance 200 includes a spring 220, a translatable pulley unit 230, a fixed pulley unit 235, a roller 239, and a cord 240 all housed with the rigid U-shaped channel 205. Attached to the two ends of the rigid U-shaped channel 205 with fasteners 212, 216 are a top guide 210 and a bottom guide 215 that are used to connect the window balance 200 to either the upper or lower window sashes 104, 106 and to help guide the vertical motion of the window balance 200 within the jamb pockets 108. The bottom guide 215 includes a back portion 213, best seen in FIG. 3, that encases a portion of the rigid U-shaped channel 205. Within the back portion 213 of the bottom guide 215 is a channel 214 sized to receive a portion of a window sash.

The rigid U-shaped channel 205 has a back wall 206 and two side walls 207, 208 that in combination form the U-shape. The rigid U-shaped channel 205 serves as an external frame to which the components of the window balance 200 can be secured. The rigid U-shaped channel 205 also keeps components located within the rigid U-shaped channel 205 free of debris and particulate matter. The spring 220, the translatable pulley unit 230, the fixed pulley unit 235, and the roller 239 are located inside the rigid U-shaped channel 205. Both of the translatable pulley unit 230 and the fixed pulley unit 235 include one or more pulleys rotatable around respective axles.

Components within the rigid U-shaped channel 205 work in combination to create a force to counterbalance the weight of the attached sash at any vertical position within the window frame 102. These components are attached to each other such that a first end 219 of the spring 220 is connected to the translatable pulley unit 230, and the translatable pulley unit 230 is connected to the fixed pulley unit 235 and the roller 239 via the cord 240. A pulley in the fixed pulley unit 235 and the roller 239 may be contained in a frame 236. To secure the components within the rigid U-shaped channel 205, the second end 221 of the spring 220 and the frame 236 are fixed to opposite ends of the rigid U-shaped channel 205 via respective fasteners 218, 243. The frame 236 is also used to secure a pulley axle 237 and a roller axle 238, around which the pulley in the fixed pulley unit 235 and the roller 239 respectively rotate. The spring 220 and the translatable pulley unit 230 are connected together by hooking the first end 219 of the spring 220 through an upper slot opening 229 in a frame 225. The frame 225 houses the translatable pulley unit 230 and a pulley axle 232 around which a pulley in the translatable pulley unit 230 rotates. The cord 240, which can be a rope, string, or cable, has a first end 241 and a second end 242. The first end 241 of the cord 240 is secured to the frame 225 and the second end 242, which is a free cord end, is threaded through the translatable pulley unit 230, the fixed pulley unit 235, and the roller 239, thereby connecting all three components together. After the cord 240 connects the three components together, the prior art terminal clip 245 is secured to the second end (terminal end) 242 of the cord 240. When the block and tackle window balance 200 is located in the jamb pocket 108, the prior art terminal clip 245 engages an aperture 430 (FIG. 4A) and the second end 242 sits within aperture 435 of one of the jamb pockets 108.

Figure 4A:
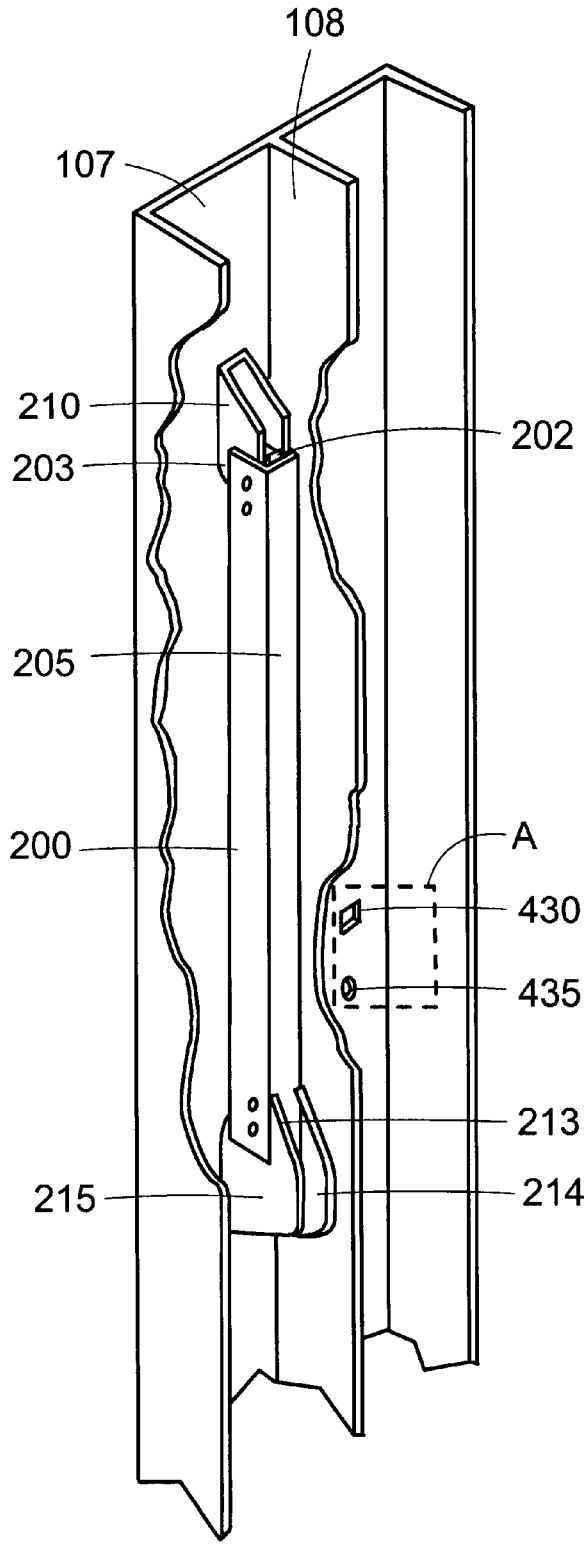
FIG. 4A is a perspective view of the block and tackle window balance of FIG. 2A within a window jamb.
Figure 4B:
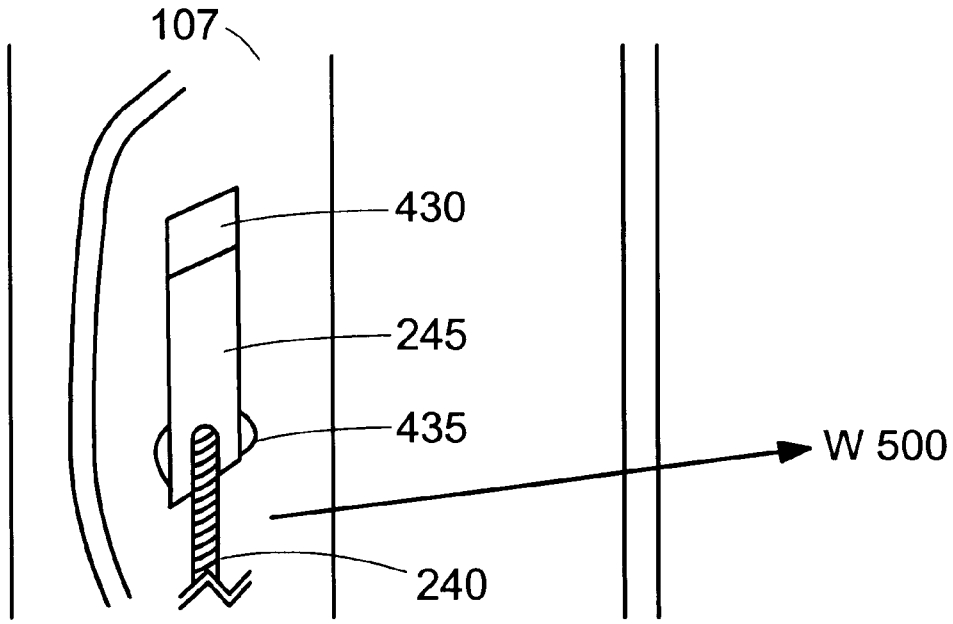
FIG. 4B is a perspective view of a portion of the window jamb labeled A in FIG. 4A including the terminal clip of FIG. 2A.

Once installed within the window assembly, the block and tackle window balance 200 is connected to both the window jamb 107 and to either the lower window sash 104 or the upper window sash 106. Referring to FIG. 4A, the block and tackle window balance 200 is attached to the window jamb 107 via the prior art terminal clip 245. The prior art terminal clip 245 is secured within aperture 430 within the jamb pocket 108, as shown in FIG. 4B. The second end 242 of the cord 240 which is knotted fits within aperture 435 such that the prior art terminal clip 245 is substantially flush with the window jamb 107. One example of the prior art terminal clip 245 including cord 240 has a thickness of about 0.120 inches to about 0.140 inches in a direction labeled W, 500 from the window jamb 107. The block and tackle window balance 200 is then connected to a window sash by inserting a portion of the window sash into the channel 314 of the bottom guide 315 and connecting the top of the window sash to the top guide 310.

Figure 5A:
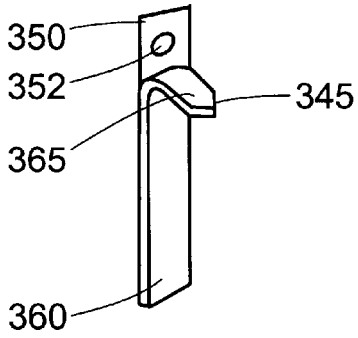
FIG. 5A is a perspective view of an embodiment of a terminal clip of the invention.
Figure 5B:
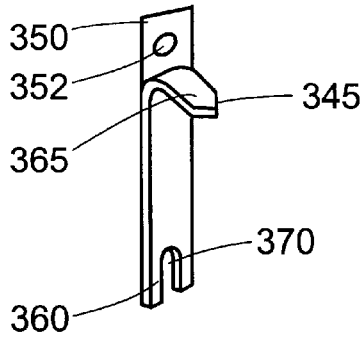
FIG. 5B is a perspective view of another embodiment of a terminal clip of the invention.
Figure 5C:
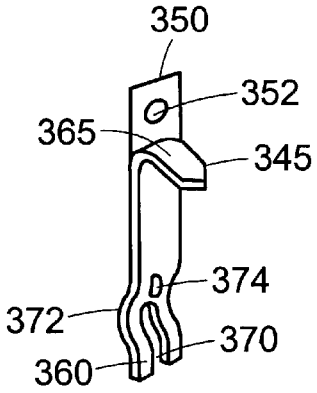
FIG. 5C is a perspective view of another embodiment of a terminal clip of the invention.
Figure 5D:
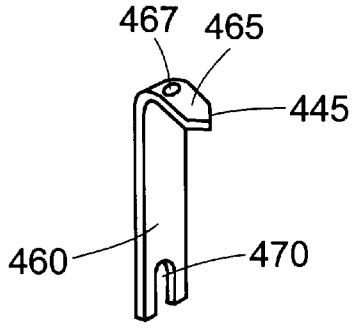
FIG. 5D is a perspective view of another embodiment of a terminal clip of the invention.
Figure 6A:
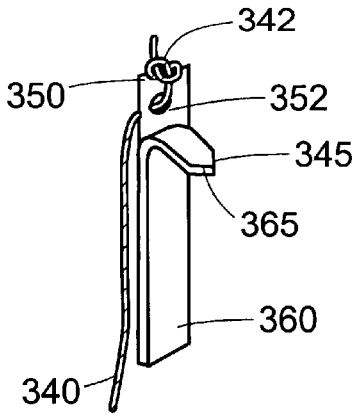
FIG. 6A is a perspective view of the terminal clip of FIG. 5A including a portion of a cord.

FIGS. 5A–5D and 6A–6D show embodiments of terminal clips 345, 445 in accordance with the teachings of the present invention. Terminal clips 345, 445 transfer force from a cord of a block and tackle window balance to a window jamb to hold up a window sash, while protecting the cord from cutting and abrasion during operation of the block and tackle window balance. Referring to FIG. 5A the terminal clip 345 includes a first end portion 350, a second end portion 360, and an intermediate portion 365. The first end portion 350 defines an opening 352 for passing a second (terminal) end 342 of a cord 340 through, as shown in FIG. 6A. To secure the cord 340 to the terminal clip 345, the second end 342 is knotted proximate to opening 352 above intermediate portion 365. The terminal clip 345 may be made of unitary construction, for example, cut and formed from a single piece of material. In some embodiments, the terminal clip 345 is formed from stainless steel.

Figure 6B:
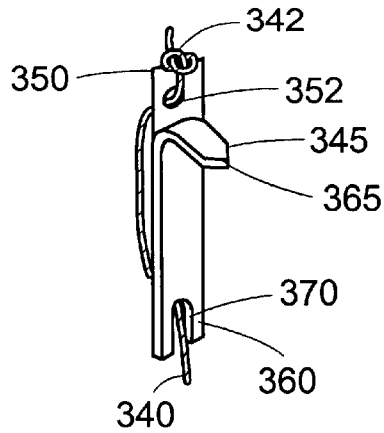
FIG. 6B is a perspective view of the terminal clip of FIG. 5B including a portion of a cord.
Figure 6C:
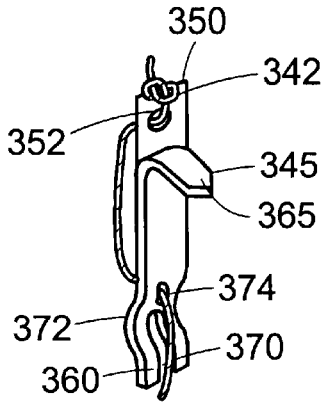
FIG. 6C is a perspective view of the terminal clip of FIG. 5C including a portion of a cord.

The cord 340 may be further secured to the terminal clip 345 by including additional openings in the second end portion 360. For example, as shown in FIGS. 5B and 6B, the second end portion 360 includes an opening 370 for the cord 340 to pass through prior to being knotted proximate to opening 352 above the intermediate portion 365. As depicted in FIG. 6B, the cord 340 extends longitudinally from the first end portion 350 to and beyond the second end portion 360. In another embodiment of the terminal clip 345, shown in FIGS. 5C and 6C, the second end portion 360 includes two openings 370, 374 for the cord to pass through and a bend 372 that protects the cord from being cut or frayed by components of the block and tackle window balance 300, such as, for example the spring 320. When the cord 340 passes through opening 370, 374 and 352, the cord extends longitudinally from the first end portion 350 to and beyond the second end portion 360.

Figure 6D:
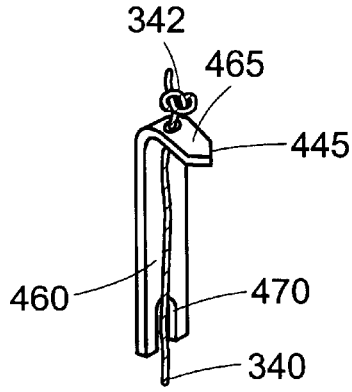
FIG. 6D is a perspective view of the terminal clip of FIG. 5D including a portion of a cord.

FIGS. 5D and 6D show another embodiment of a terminal clip 445 in accordance with the teachings of the present invention. Terminal clip 445 includes a first end 460 and a hooked end 465. The hooked end defines an opening 467 for the cord 340 to pass through. The second end 342 of the cord is knotted after passing through opening 467 to secure the cord 340 to the terminal clip 445. The first end 460 of the terminal clip 445 can include one or more openings 470 for the cord to pass through prior to being knotted above opening 467. In addition, the first end 460 may include a bend (not shown) similar to bend 372 of terminal clip 345 shown in FIGS. 5C and 6C.

Figure 7:
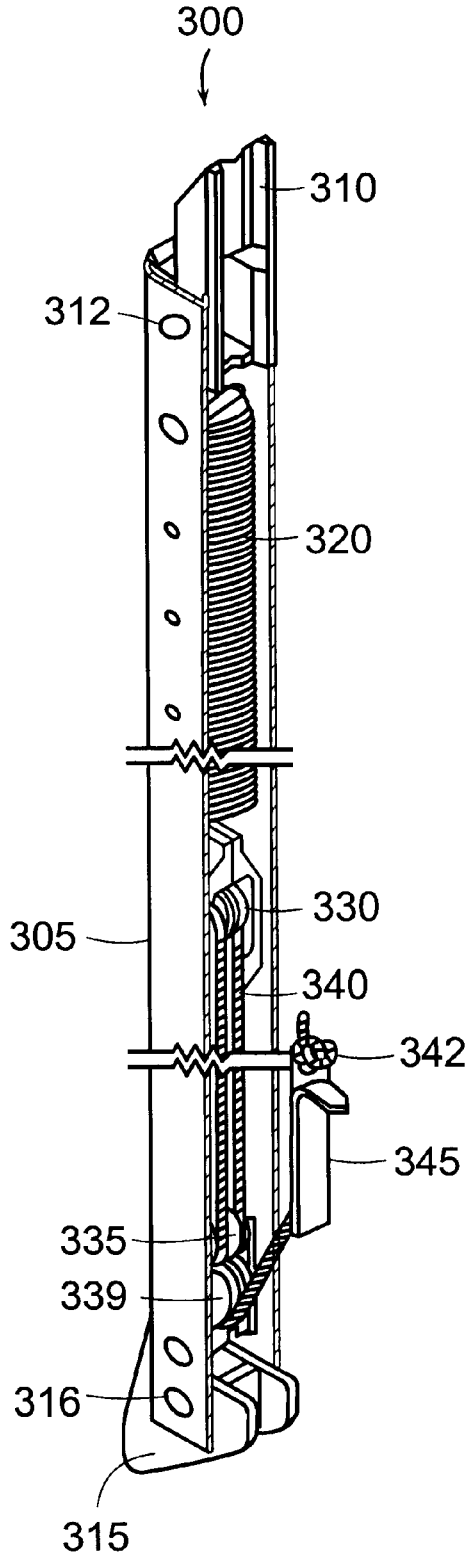
FIG. 7 is a perspective view of an embodiment of a block and tackle window balance including the terminal clip of FIG. 5A.
Figure 8:
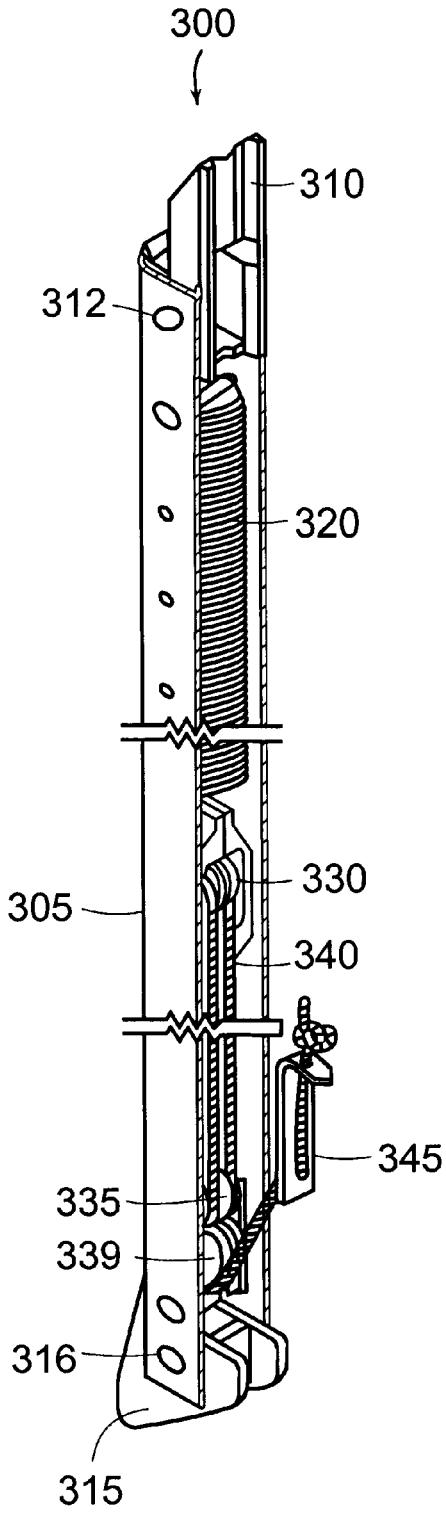
FIG. 8 is a perspective view of an embodiment of a block and tackle window balance including the terminal clip of FIG. 5D.
Figure 9:
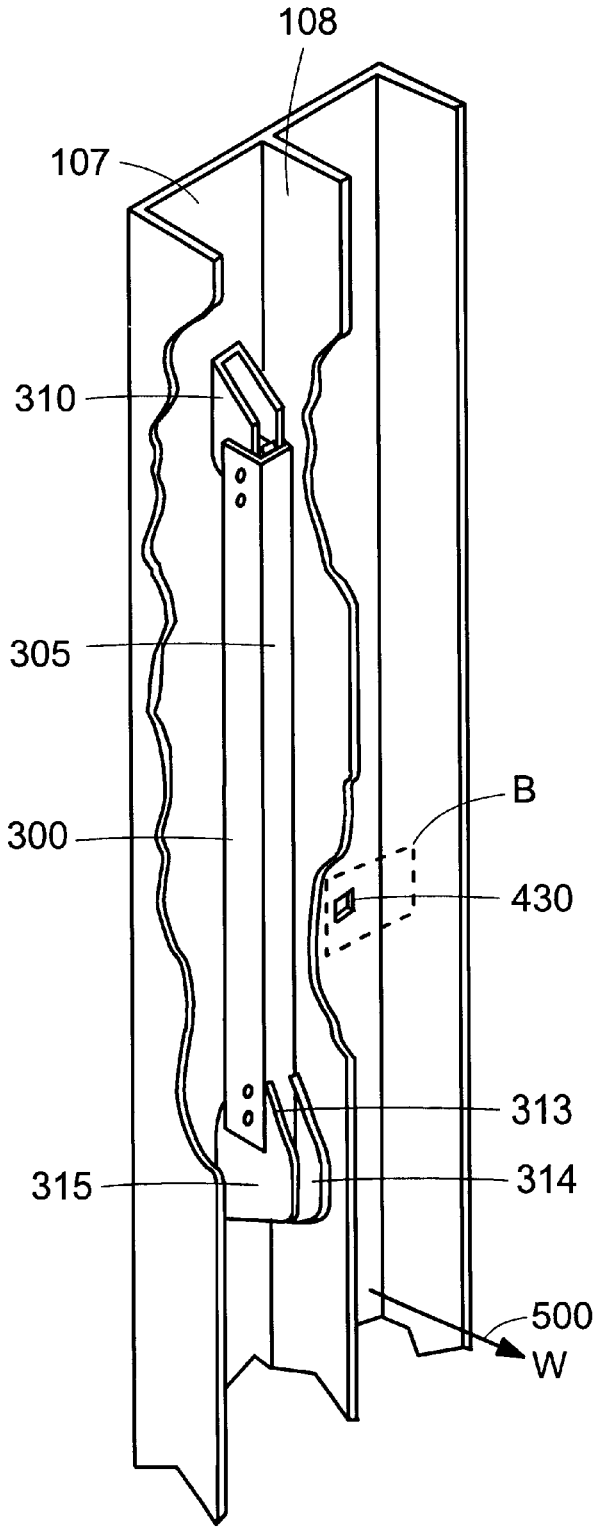
FIG. 9 is a perspective view of an embodiment of a block and tackle window balance of the invention mounted within a window jamb.

As shown in FIGS. 7 and 8, a block and tackle window balance 300 in accordance with the teachings of the present invention includes a rigid U-shaped channel 305, a top guide 310, a bottom guide 315, a spring 320, a translatable pulley unit 330, a fixed pulley unit 335, a roller 339, the cord 340, and one terminal clip 345, 445. (FIG. 7 includes terminal clip 345, whereas FIG. 8 includes terminal clip 445). The top guide 310 and the bottom guide 315 are fixed to the rigid U-shaped channel 305 by fasteners 312, 316. The top guide 310 is used to help connect the block and tackle window balance 300 to the window sash 104, 106 and to help guide the movement of the block and tackle window balance 300 within the jamb pocket 108. The bottom guide 315 is also used for connection and guidance purposes. A back portion 313 of the bottom guide 315 may include a channel 314 for receiving a portion of the window sash, as depicted in FIG. 9.

Figure 10:
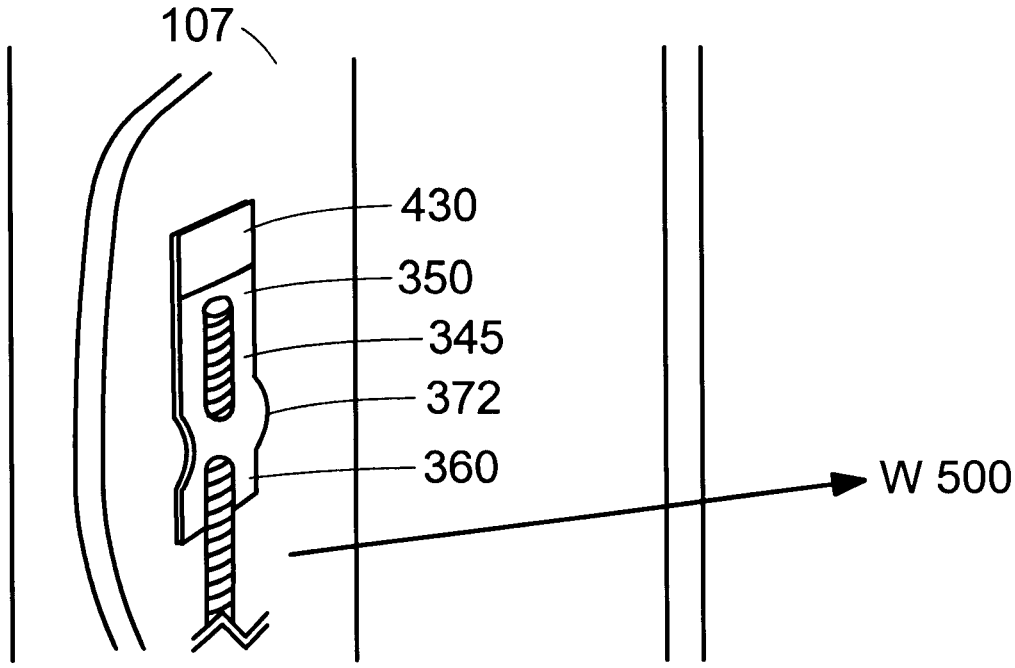
FIG. 10 is a perspective view of a portion of the window jamb labeled B in FIG. 9 including the terminal clip of FIG. 5A.

To install the block and tackle window balance 300 within a window frame 102, the terminal clip 345, 445 is attached to the window jamb 107. The intermediate portion 365 or the hooked portion 465 is inserted and secured within aperture 430 of the window jamb 107, as depicted in FIGS. 9 and 10. Because the second end 342 of the cord 340 forms a knot above the intermediate portion 365 (or the hooked portion 465) the second end 342 of the cord 340 is also inserted into aperture 430. Accordingly, there is no need for a second separate opening to be formed within window jamb 107. Thus, one of the advantages of terminal clips 345, 445 of the present invention over prior art terminal clips 245 is that the window frame 102 requires less processing because both the intermediate portion 365 (or hooked portion 465) and the knotted second end 342 fit within aperture 430. As such, a manufacturer of the window frame 102 needs to cut only one aperture 430 in the windowjamb 107 instead of two apertures 430, 435 as required by the prior art terminal clip 245 shown in FIG. 4B. The additional aperture 435 may cause additional air infiltration and may lead to weakening the window frame 102. Thus, it is advantageous to have fewer apertures cut within the window jamb 107.

Another advantage of the terminal clips 345, 445 is cord 340 protection during operation of the block and tackle window balance 300. If a cord and/or a terminal clip of a block and tackle window balance extends too great a distance (e.g., beyond about 0.120 inches) in the direction labeled W, 500 shown in FIG. 9 from the window jamb 107, the cord may be cut or damaged by the components within the block and tackle window balance. Additionally, a terminal clip that extends out further than about 0.120 inches, for example, in the W direction, 500 may interfere with the vertical motion of the block and tackle window balance within jamb pockets 108. Typically, prior art terminal clips 245 have a thickness of about 0.120 inches to about 0.140 inches in the W direction, 500. Also, due to the connection between the prior art terminal clips 245 and the cord 240, the highest projection point in the W-direction, 500 is the cord 240, as shown in FIG. 4B. Thus, prior art terminal clips 245 expose the cord 240 to possible damage by the block and tackle window balance 200.

Alternatively, terminal clips 345, 445 constructed in accordance to the teachings of the present invention are designed such that the maximum thickness in the W-direction, 500 is about 0.100 inches, thereby preventing both the cord 340 and the terminal clip 345, 445 from interfering during operation of the block and tackle window balance 300. To provide additional cord 340 protection, the terminal clips 345, 445 may include a bend 372, as shown in FIG. 10, that projects out a greater distance in the W-direction 500 than the cord 340. As such, the bend 372 defines an uppermost extent of the terminal clip 345 and shields the cord 340 from being cut or frayed during operation of the block and tackle window balance 300.

Variations, modifications, and other implementations of what is described herein will occur to those of ordinary skill in the art without departing from the spirit and the scope of the invention as claimed. Accordingly, the invention is to be defined not by the preceding illustrative description but instead by the spirit and scope of the following claims.

What is claimed is:

1. A terminal clip for a balance for a window, the terminal clip comprising:

a first end portion defining an opening for passing a terminal end of a cord therethrough;

a second end portion disposed remotely from the first end portion; and an intermediate portion extending between the first end portion and the second end portion, the intermediate portion comprising a hook disposed at an acute angle relative to the intermediate portion for attaching the terminal clip to a window frame.

2. The terminal clip of claim 1 wherein the second end portion comprises a bend and defines at least one second end opening for the cord to pass through.

3. The terminal clip of claim 2 wherein the second end portion defines two second end openings for the cord to pass through.

4. The terminal clip of claim 1 further comprising stainless steel.

5. The terminal clip of claim 1 wherein the terminal clip is formed of unitary construction.

6. The terminal clip of claim 1 wherein the opening is sized for close passage of the cord therethrough.

7. The terminal clip of claim 6 wherein, when installed in the window frame, the terminal clip is sized to substantially shield the terminal end of the cord.

8. The terminal clip of claim 1 wherein, when installed in the window, the terminal clip is sized such that the terminal end of the cord does not extend beyond the terminal end of the clip when the cord is knotted proximate the terminal end of the cord.

9. A terminal clip for a balance for a window, the terminal clip comprising:

a first end defining at least two openings for a cord to pass through, wherein one opening is fully defined by the first end and one opening is only partially defined by the first end; and a hooked end disposed remotely therefrom.

10. The terminal clip of claim 9 wherein the first end comprises a bend between the at least two openings.

11. The terminal clip of claim 9 wherein the terminal clip is formed of unitary construction.

12. The terminal clip of claim 9 wherein, when installed in the window, the terminal clip is sized to substantially shield the terminal end of the cord.

13. A terminal clip for a balance for a window, the terminal clip comprising:

a first terminal end; and a hooked end adapted to engage a window frame, the hooked end disposed substantially linearly from the first terminal end and defining an opening for passing a terminal end of a cord therethrough.

14. The terminal clip of claim 13 wherein the first end defines at least one opening for the cord to pass through.

15. The terminal clip of claim 13 wherein the terminal clip is formed of unitary construction.

16. The terminal clip of claim 13 wherein the opening is sized for close passage of the cord therethrough.

17. The terminal clip of claim 16 wherein, when installed in the window frame, the opening is defined in a portion of the hooked end such that, when the cord is knotted proximate the terminal end of the cord, the knot is at least partially recessed into an aperture in the window that receives the hooked end.

18. A block and tackle window balance device comprising:

a channel comprising a first end and a second end;

a fixed pulley block unit connected to the channel;

a translatable pulley block unit moveable within the channel;

a spring comprising a first end and a second end, wherein the first end is fixed relative to the channel and the second end is connected to the translatable pulley block unit;

a cord comprising a first cord end and a second cord end; and a terminal clip comprising a first end and a hooked end disposed remotely therefrom and defining an opening for passing the second end of the cord therethrough;

wherein the cord is threaded through the translatable pulley block unit and the fixed pulley block unit, the first cord end being attached to the translatable pulley block unit and the second cord end being attached to the terminal clip.

19. A terminal clip for a balance for a window, the terminal clip comprising:

a first end portion defining an opening for passing a terminal end of a cord therethrough;

a second end portion disposed remotely from the first end portion, wherein the second end portion comprises a bend and defines at least two second end openings for the cord to pass through; and an intermediate portion extending between the first end portion and the second end portion, the intermediate portion comprising a hook for attaching the terminal clip to a window frame.

20. A terminal clip for a balance for a window, the terminal clip comprising:

a first end defining at least two openings for a cord to pass through and a bend between the at least two openings; and a hooked end disposed remotely therefrom.

* * * * *